US006427423B1

(12) United States Patent
Hinzman et al.

(10) Patent No.: US 6,427,423 B1
(45) Date of Patent: Aug. 6, 2002

(54) COUPON INSERTER FOR HINGE LID PACK

(75) Inventors: Tom Hinzman; Mark Baker; Rickey Johnson; Weston Johnson, all of Macon, GA (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 09/702,110

(22) Filed: Oct. 30, 2000

Related U.S. Application Data

(60) Provisional application No. 60/182,425, filed on Feb. 14, 2000.

(51) Int. Cl.[7] ..... B65B 61/20

(52) U.S. Cl. ..... 53/474; 53/415; 53/135.1

(58) Field of Search ..... 53/135.1, 239, 53/238, 240, 415, 474

(56) References Cited

U.S. PATENT DOCUMENTS

| | | | | |
|---|---|---|---|---|
| 1,200,227 A | | 10/1916 | Pantazi | |
| 4,019,413 A | | 4/1977 | Davies et al. | |
| 4,175,456 A | | 11/1979 | Seragnoli | |
| 4,198,258 A | | 4/1980 | Glosmann | |
| 4,268,344 A | * | 5/1981 | Jones | 53/397 |
| 4,330,976 A | | 5/1982 | Blackall et al. | |
| 4,423,584 A | | 1/1984 | Eloner et al. | |
| 4,557,101 A | | 12/1985 | Hesterberg | |
| 4,658,564 A | | 4/1987 | Bell, Jr. et al. | |
| 4,741,145 A | | 5/1988 | Bright et al. | |
| 5,129,641 A | | 7/1992 | Long | |
| 5,146,728 A | | 9/1992 | Knecht et al. | |
| 5,163,268 A | | 11/1992 | Vaccari et al. | |
| 5,353,815 A | | 10/1994 | Gamberini et al. | |
| 5,425,217 A | | 6/1995 | Lobash et al. | |
| 5,533,613 A | | 7/1996 | Minarelli et al. | |
| 5,657,609 A | | 8/1997 | Spada et al. | |
| 5,715,936 A | | 2/1998 | Focke et al. | |
| 5,782,736 A | | 7/1998 | Brizzie et al. | |
| 5,784,861 A | * | 7/1998 | Kotsiopouylos | 53/435 |

* cited by examiner

*Primary Examiner*—Scott A. Smith
*Assistant Examiner*—Chukwurah Nathaniel
(74) *Attorney, Agent, or Firm*—John F. Salazar; Charles G. Lamb; Middleton Reutlinger

(57) ABSTRACT

The present invention is directed toward an apparatus for insertion of coupons or other material into hinge lid pack cigarettes. The apparatus of the present invention inserts the coupons in between the foil wrapped pack of cigarettes and the inner frame portion of the hinged lid pack. The apparatus of the present invention is comprised of a coupon inserter, a third wheel pocket and rail system wherein the pockets travel rotationally with the third wheel after receiving a coupon and thereafter allow the foil wrapped cigarette pack to be inserted thereon. The rail of the hinged lid pack assembly machine has been modified to receive these coupons in conjunction with the coupon multistage inserter or dispenser and all act cooperatively such that the coupons are inserted in timed relation to the rotational speed of the third wheel of the packager.

15 Claims, 7 Drawing Sheets

COUPON INSERTER FOR HINGE LID PACK

PRIORITY OF THE INVENTION

This application claims the benefit of U.S. Provisional Application No. 60/182,425, filed on Feb. 14, 2000.

BACKGROUND OF THE INVENTION

1. Field of the Invention

The present invention is directed toward machinery for insertion of coupons in a hinged lid pack of cigarettes. More specifically the present invention is directed toward the insertion of the coupon between the inner foil wrap and the inner frame portion of the hinged lid box.

2. Discussion of the Prior Art

Hinge lid cigarette pack making machines are fairly well known in the art. These machines wrap the cigarettes in a foil or other material and then insert the foil into a pocket or other surrounding device which allows the foil wrapped cigarettes to be inserted into a hinged lid carton or allows the hinged lid carton to be formed around them. In most machines this occurs by wrapping the cigarettes in a foil type material, transferring this wrapped pack of cigarettes to a transfer station, and inserting around the foil wrapped cigarettes the inner-frame portion of the hinged lid cigarette pack.

It has also been very common in the prior art to attempt insertion of a coupon or other advertising material into the cigarette pack. This has either been achieved through insertion of the coupon or other material in the inner lining or foil wrap lining so that the material is directly adjacent to the cigarettes or attachment of the coupon or advertising material to the exterior portion of the cigarette of the hinged lid box. It may however be desirable to accomplish insertion of the coupon in between the inner frame portion of the hinge lid box and the foil wrapping material around the cigarettes. Insertion of the coupon at this point allows the user to visibly see the coupon upon opening of the hinged lid top portion of the package prior to peeling away the foil covering the top portion of the wrapped cigarettes. However, as noted herein, prior art machines have typically allowed for insertion of the coupon material only in the inner portion of the wrapped cigarettes, i.e. the coupon is wrapped with the cigarettes by the foil, or attachment of the coupon to the exterior of the packaging. Neither of these two alternatives is very desirable in that they interfere with the packaging process or they may impart undesirable characteristics to the flavor of the tobacco.

It is commonly known that inks or other additives commonly found on coupons and advertising material may negatively impact the flavor of tobacco. This especially occurs if the material is contained in the interior portion of the wrapped cigarettes inside of the cellophane wrapping. While some of these problems have been overcome, it has further been problematic in inserting coupons in the interior of foil wrapped cigarettes since insertion at this point can cause packaging problems further down the line and also since the consumer may not readily see the coupon or other inserted material. It is further undesirable to attach or adhere coupons or other material to the exterior portion of the pack since this takes away from the overall appearance of the packaging.

None of these prior art systems allow for insertion of coupons or other material in a readily visible position when the hinge lid pack is initially opened by the consumer.

SUMMARY OF THE INVENTION

The present invention is directed toward a coupon inserter for inserting coupons or other material in a hinged lid pack between the foil and the inner frame portion of the hinged lid package. The apparatus of the present invention is designed to overcome the problems heretofore known in the hinged lid packaging industry.

It is therefore an object of the present invention to provide a coupon inserting apparatus for insertion of coupons into a hinged lid pack of cigarettes wherein the coupon is inserted between the foil and inner frame portion of the hinged lid pack.

It is another object of the present invention to insure that a coupon or other material is positioned in between the foil wrapping material and the inner frame portion of the hinged lid pack such that the consumer, upon flipping open the hinged lid top, readily sees the coupon or other advertising material.

It is a further object of the present invention to integrate a coupon inserting apparatus with a standard hinged lid pack making machine such that currently existing pack making machines may be retrofitted to include the coupon inserter of the present invention.

It is an additional object of the present invention to provide insertion of the coupon or other material in a timely fashion along the third wheel and in the third wheel pocket of known hinged lid pack making machines such that the coupon is positioned properly prior to insertion of the foil wrapped cigarettes along the inner frame portion of the pack.

It is a further object of the present invention to provide a coupon insertion machine which operates and which is integrated with the third wheel portion of a hinged lid packing machine such that the coupon inserter works in unison with the speed of the packing machine.

It is a further object of the present invention to provide a third wheel portion of a hinged lid packing machine such that a coupon may be inserted directly in the third wheel pocket.

A further object of the present invention is to modify the rail portion of the third wheel section of the hinged lid packing machine such that a coupon, which may be inserted in the third wheel pocket, maintains its position as the third wheel pocket rotates and passes below the insertion point of the foil wrapped cigarette pack.

An even further object of the present invention is to provide a controller for controlling the coupon inserter such that the controller is operably connected to the hinge lid packing machine in order to determine the rotational speed of the third wheel thereby dispensing coupons from the coupon dispenser at an adequate speed corresponding to the rotational speed of the third wheel.

These and other objects of the present invention will be apparent to those skilled in the art from the following detailed description of the invention, the accompanying drawings and the appended claims.

DETAILED DESCRIPTION OF THE PREFERRED EMBODIMENT

Figure 1:
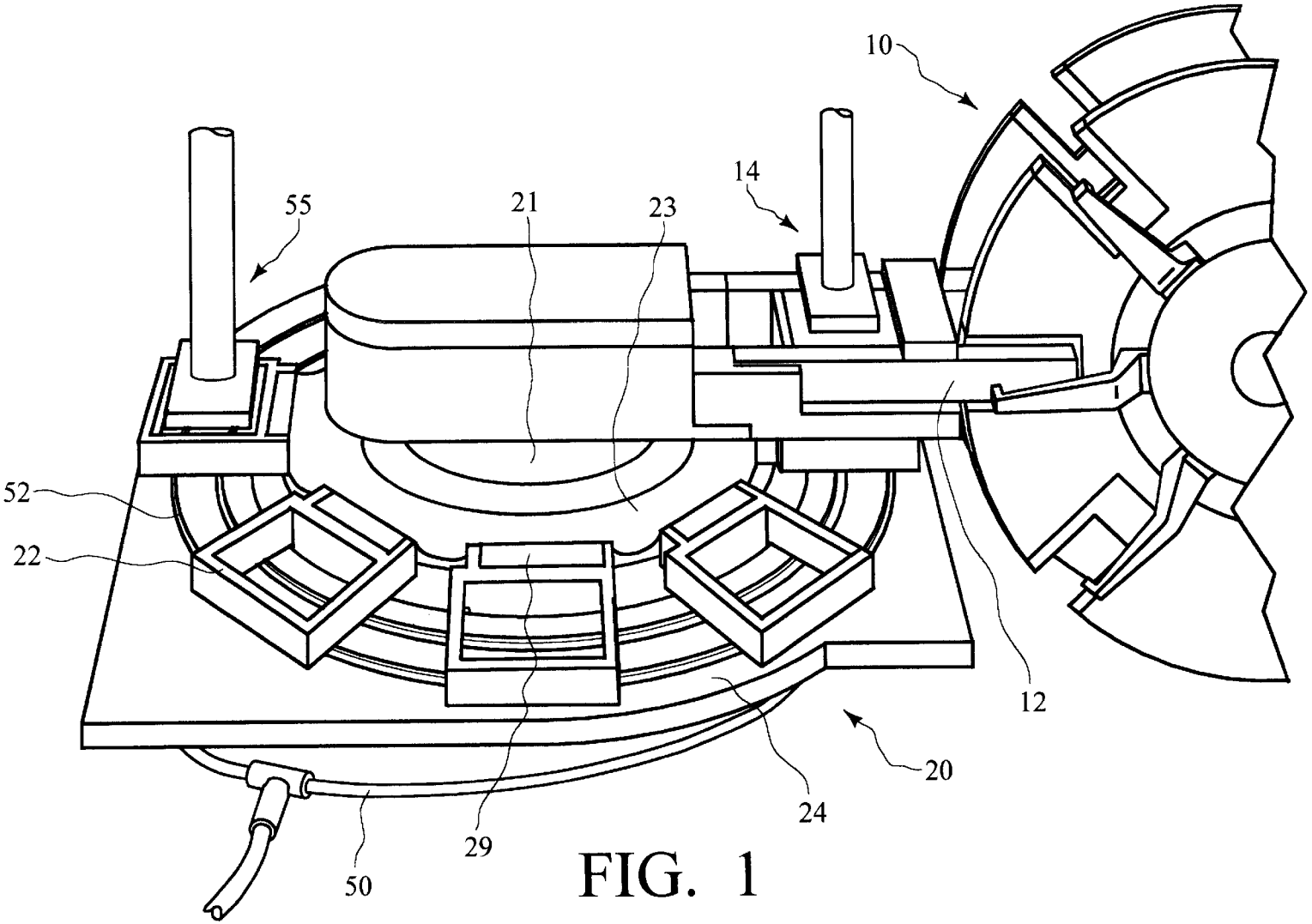
FIG. 1 is a perspective view of the foil wrapper and third wheel portion of a hinged lid pack machine.

The coupon inserter for hinged lid packs of the present invention is generally shown in FIGS. 2 through 7. Standard prior art hinged lid pack machinery however is shown in FIG. 1 except for some of the modifications made for the design of the present invention. In standard machines, a foil wrapper section 10 of the packing machinery receives cigarettes within a pocket 12 and wraps those cigarettes with foil or other material. At transfer station 14, the foil wrapped cigarette pack is transferred over to the third wheel portion 20. The third wheel portion 20 is comprised of the third wheel 23, rotating third wheel pockets 22, rail 24 and push down transfer station 55. Third wheel pockets 22 move counter-clockwise along the rail 24 and are guided through rail guide grooves 52. Third wheel 23 has a plurality of outward extensions or outwardly extending peripheral segment 29 extended in order to contact the third wheel pockets 22 and enable them to be rotated along rail 24. Third wheel pockets 22 receive a foil wrapped packet of cigarettes at the transfer station 14 and rotate them to the push down transfer point 55 where the foil wrapped cigarettes are wrapped with inner frame portions of a cigarette flip top carton.

The third wheel 23 shown in FIG. 1 rotates around hub 21 and rotates at sufficient speed so that approximately 400 packs per minute may be processed through the third wheel portion 20 of the hinged lid pack machine.

Figure 2:
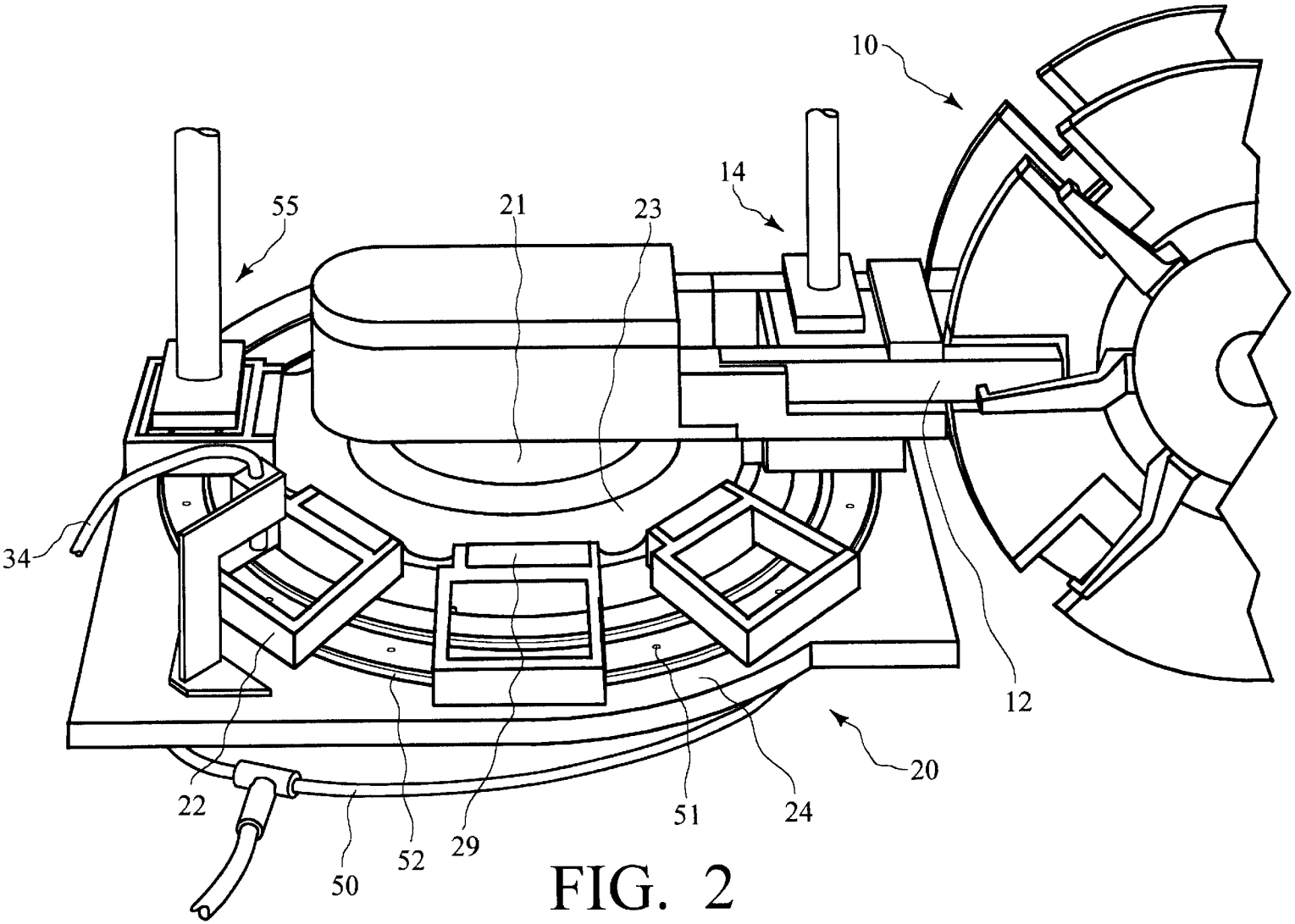
FIG. 2 is a perspective view of the hinged lid pack machine of the present invention wherein the third wheel portion is visible and the coupon inserter is removed from view for a clear view.

Turning now to FIG. 2, a portion of the apparatus of the present invention is shown. Third wheel 23 has been modified such that the rail 24 is provided with a plurality of vacuum apertures 51 which extend along the rail 24. Support arm 25 is also provided to support an air nozzle 32 directly above the center portion of rail 24 such that the third wheel pockets 22 pass directly there below. Not shown in FIG. 2 is the actual coupon inserting device to be described herein but which works in conjunction with these modifications and which dispenses coupons singularly into each of the third wheel pockets 22.

As can be seen in FIG. 2, the plurality of vacuum apertures 51 are placed centrally in between the rail guides 52 which guide the third wheel pockets 22 along the circular route of rail 24. Third wheel 23 and outwardly extending peripheral segmants 29 rotate the third wheel pockets 22 in a counter-clockwise direction so that they appropriately pass through the requisite stations.

As can also be seen in FIG. 2, the vacuum apertures 51 are supplied by the vacuum air line 50 which extends directly below the rail 24 to provide a vacuum source to each of the apertures 51. Apertures 51 are provided at regular intervals along the rail 24 so that a coupon which is inserted at a station adjacent to air nozzle 32 remains in place during the further assembly and insertion of the cigarette pack into the third wheel pocket.

Support arm 25 provides an attachment point for air nozzle 32 which is directed downwardly from the upper arm of the support arm. Air nozzle 32 is supplied with a high pressure air source through air line 34 such that a blast of air may be provided after insertion of the coupon into the third wheel pocket 22 in order to push the coupon flat against the rail 24. Again, not shown in FIG. 2 is the actual coupon inserting device which works in conjunction with this structure and which dispenses the coupons into the third wheel pockets 22.

Figure 3:
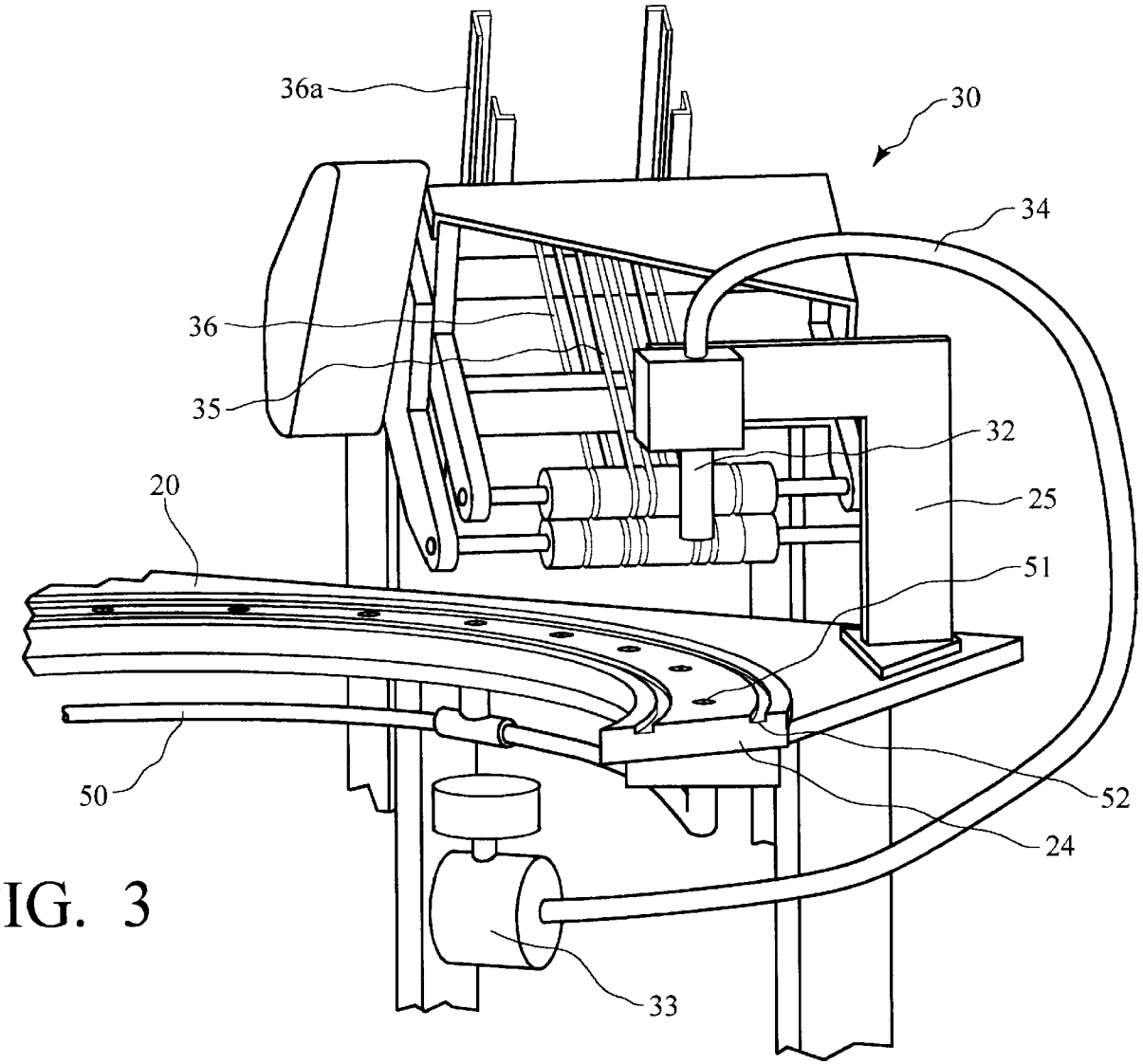
FIG. 3 is a side view of the coupon inserter for hinged lid packs of the present invention wherein the rail of the third wheel portion of the hinged lid pack machine and the coupon inserter are visible.

Turning to FIG. 3, the coupon inserter 30 which works in conjunction with the modifications to the third wheel portion 20 is shown. Coupon inserter 30 is comprised of an upper belt 35 and lower belt 36 which receives coupons singularly from a coupon magazine 36*a*. The coupon inserter 30 is a multiple stage dispenser for receiving coupons located in coupon magazine 36 and dispensing them one at a time in between upper belt 35 and lower belt 36 such as that disclosed in U.S. Pat. No. 5,129,641 incorporated herein by reference. The coupon inserter 30 feeds coupons downward along belts 35 and 36 to a point directly above the rail 24. At the dispensing point of the coupons at the end of upper and lower belts 35 and 36 is found an air nozzle 32 which is supplied with high pressure air through air line 34.

Air line 34 receives high pressure through air valve 33 such that the blast of air is directed downward through nozzle 32 and may be controlled and timed with the appropriate dispensing of a coupon at the end of upper and lower belt 35 and 36. As can be seen from the view in FIG. 3, rail 24 has an inner and outer rail guide 52 which has located there between a plurality of apertures 51. The third wheel pockets 22 previously described travel along the rail guides 52 and directly below air nozzle 32. As may be understood, the coupon inserter 30 dispenses a coupon from the coupon magazine 36 and allows that coupon to travel in between upper and lower belt 35 and 36. As the coupon travels downward between the belts, it is eventually dispensed at a position directly above the rail 24 and below the air nozzle 32 such that the coupon is dispensed into the third wheel pocket passing there below. After dispensing the coupon into the third wheel pocket, valve 33 opens allowing high pressure air to pass through airline 34 and out air nozzle 32. The blast of high pressure air insures that the coupon is pushed downward securely into the third wheel pocket for proper positioning when the cigarette pack is later formed.

As is also shown in FIG. 3, the air line 50 needed for providing vacuum to vacuum apertures 51 is shown. Vacuum air line 50 is connected to a vacuum source which is not shown, but which continually provides the vacuum necessary to retain the coupon in a flat position along rail 24.

Figure 4:
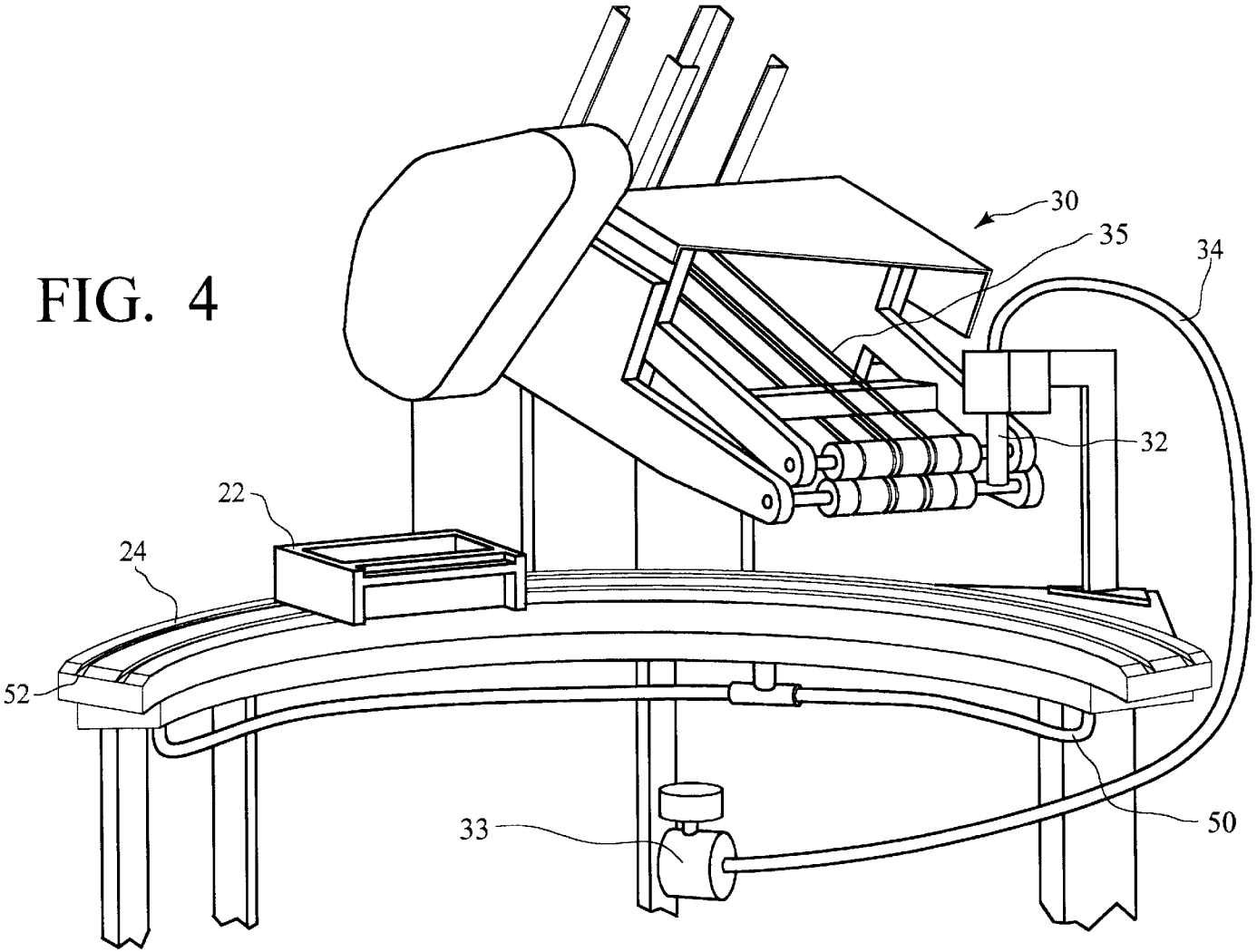
FIG. 4 is a side view of the rail and coupon inserter for hinged lid packs of the present invention.

Turning to FIG. 4, the coupon multi-stage dispenser 30 is shown. Upper belt 35 is visible as well as air nozzle 32 and air supply hose 34. Rail 24 works in conjunction with third wheel pocket 32 allowing the third wheel pocket 22 to slide along rail 24 securely retained within rail guides 52. As depicted in FIG. 4, third wheel pocket 22 moves from left to right directly below the lower distal end of the upper belt 35 and directly below air nozzle 32. Air valve 33 allows the high pressure air to pass along the air hose 34 such that at the dispensing point of the coupon into third wheel pocket 22 a blast of air is provided to force the coupon down and flat against rail 24 which is then subsequently held into place by vacuum apertures not shown in this Figure.

The rail 24 depicted in FIG. 4 is integrated with the third wheel portion 20 shown in FIG. 2 such that the coupon inserter 30 may be placed at a position directly past, in a counter-clockwise direction, the push down transfer station 55. Therefore, the coupon inserter 30 or multi-staged dispenser may dispense the coupons at a point directly adjacent the air nozzle 32 and support arm 25 shown in FIG. 2. The entire assembly may be integrated as a single unit as depicted in FIG. 4 for easy insertion into a standard third wheel portion of a hinged lid cigarette pack machine thereby replacing a section of the rail adjacent the third wheel.

Figure 5:
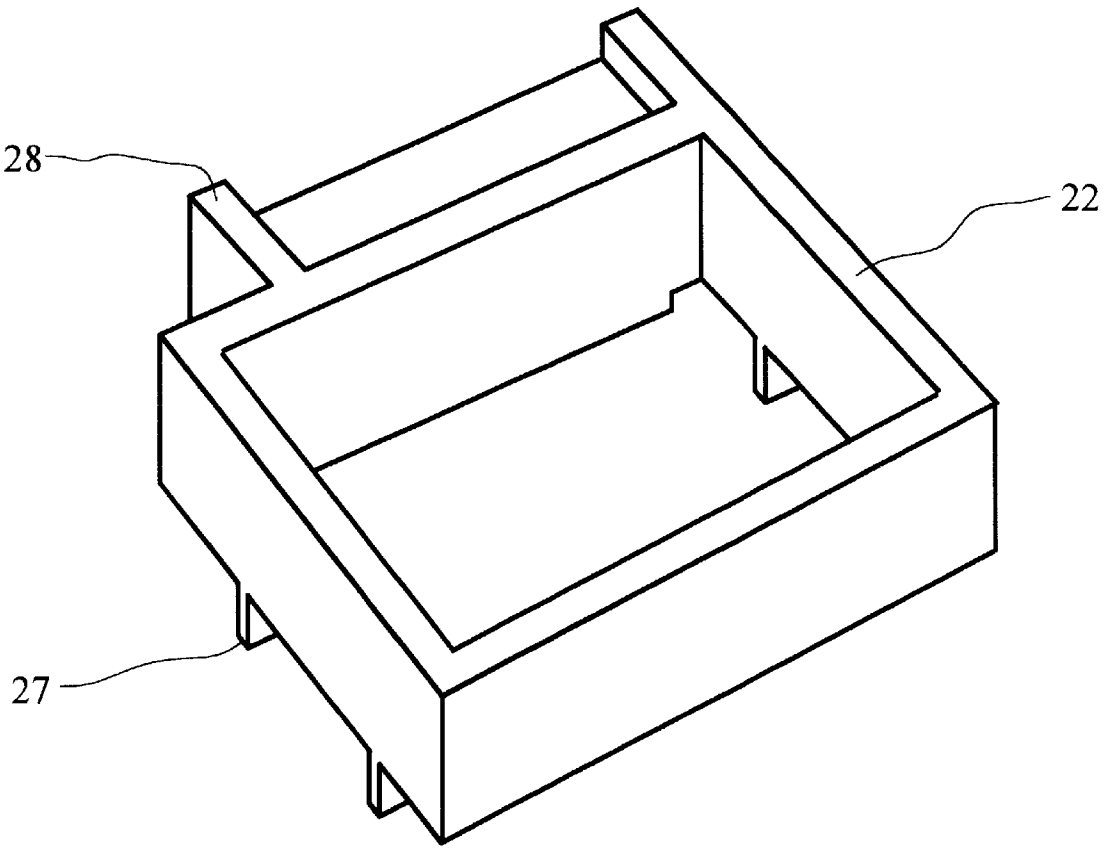
FIG. 5 is a top perspective view of the third wheel pocket utilized in the coupon inserter for hinged lid packs of the present invention.

Turning to FIG. 5, the third wheel pocket utilized in the present invention is shown, third wheel pocket 22 has rail guide inserts 27 which are received within the rail guides 52 of rail 24. Rail guide inserts 27 allow the third wheel pocket 22 to travel along the entirety of rail 24 without becoming displaced and maintaining correct position in the hinged lid pack machinery. Third wheel pocket 22 is also provided with an armature bracket 28 which surrounds outwardly extending periphery section 29 of the third wheel 23 shown in FIG. 1. As also can be seen from FIG. 5, the third wheel pocket has a hollow interior for forming the requisite hinged lid cigarette pack therein. Thus, the foil wrapped cigarette pack may be placed into the interior of the third wheel pocket 22 and moved along the annular rail 24 of the machinery of the present invention. At the requisite push down transfer station, the foil wrapped cigarette pack may then be transferred to another station by pushing the foil wrapped pack downward through an opening in rail 24 and with an innerframe portion of the hinged lid pack.

Figure 6:
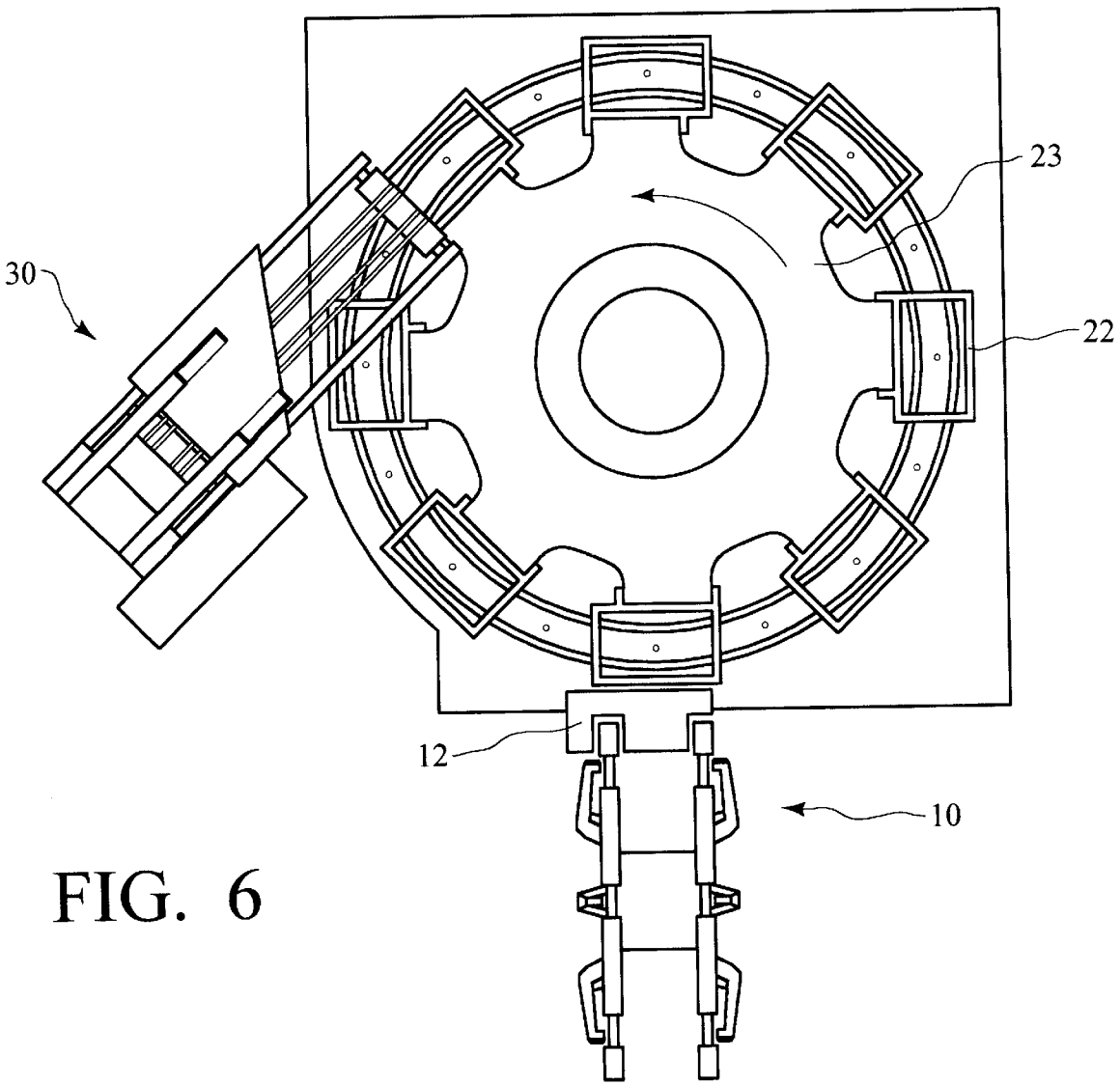
FIG. 6 is a top view of the coupon inserter for hinged lid packs and hinged lid pack machinery of the present invention.

Turning to FIG. 6, a top view of the machinery of the present invention is shown. Coupon inserter 30 feeds coupons singularly to the third wheel pockets 22. Third wheel 23 rotates counter-clockwise thereby receiving a coupon into the empty third wheel pocket 22. As the third wheel pocket 22 rotates further in the counter-clockwise direction, the third wheel pocket will receive a foil wrapped pack of cigarettes from foil wrapper 10. Pockets 12 of the foil wrapper 10 contain therein the foil wrapped cigarette pack which are transferred to the third wheel pockets 22 at transfer station 14 shown in FIG. 1. Third wheel 23 and foil wrapper 10 rotate in unison such that their timing is interconnected and allows for the proper transition of the foil wrapped cigarette packs from the pocket 12 to the third wheel pockets 22.

As can be seen from the positioning of the apparatus in FIG. 6, the third wheel 23 rotates in the counter-clockwise direction allowing the coupon to be inserted into the third wheel pocket 22 at approximately the ten o' clock position. After insertion of the coupon or other material into the third wheel pocket 22, the third wheel 23 continues rotation along rail 24 not shown. Eventually, at the six o'clock position, the foil wrapped cigarette pack is transferred from the foil wrapper 10 and pocket 12 to the third wheel 22 so that the foil wrapped cigarette pack rests on top of the coupon which has previously been inserted into third wheel pocket 22. Continued rotation of the third wheel 23 in the counter-clockwise direction positions the foil wrapped cigarette pack and coupon eventually at the twelve o'clock position which corresponds to the push down transfer station 55 depicted in FIGS. 1 and 2. At this position, the foil wrapped cigarette pack and the coupon or other material are pushed down through rail 24 which has an opening therein for the transfer station 55 and into another piece of machinery which contains the inner frame portion of the hinged lid flip top box.

As previously indicated, the positioning of the coupon or other material is such that when the user flips the hinged lid top open to obtain access to the cigarettes, the coupon is present directly adjacent to the flip top opening. As one of ordinary skill in the art is aware, the inner frame section of the flip top box is directly behind the front face of the flip top portion of the hinged lid box. The apparatus of the present invention inserts the coupon or other material directly in between the inner framed portion and the foil wrapped lining material such that upon initial opening of the flip top or hinged lid box, the coupon or other material is directly visible and must be removed by the user prior to removing the foil overwrap.

Figure 7:
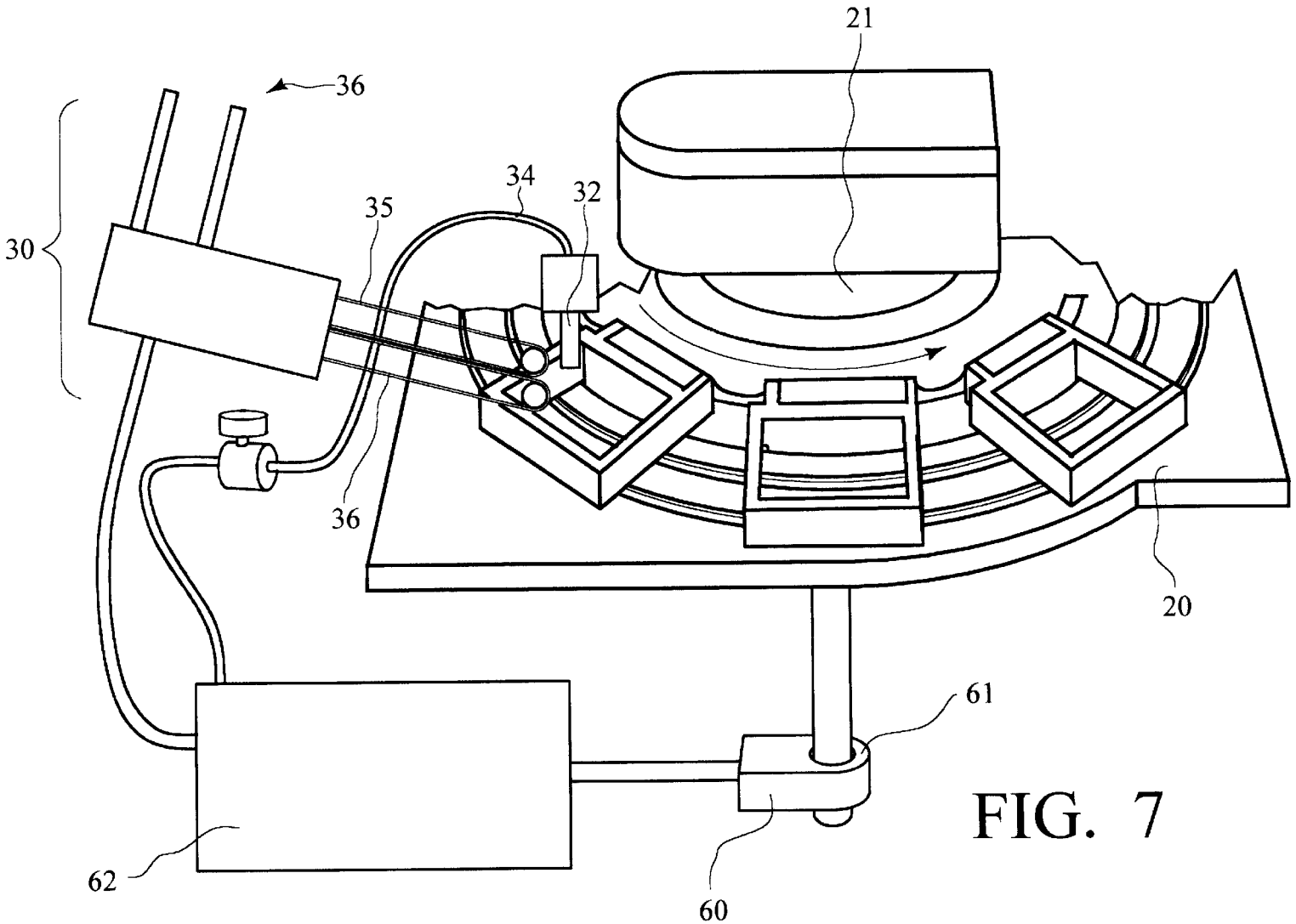
FIG. 7 is a simplified schematic view of the connection between the third wheel portion of the hinged lid pack machine of the present invention and the coupon inserter.

Turning to FIG. 7, the apparatus and machinery of the present invention is shown in schematic form wherein the coupon inserter 30 and the third wheel portion 20 is schematically depicted. Hub 21 rotates in the counter-clockwise direction at the predefined speed of the third wheel. Coupon inserter 30 feeds coupons from the coupon magazine 36 in between upper belt 35 and lower belt 36. Coupon inserter 30 dispenses the coupons over the third wheel at a predetermined rate. Coupon inserter 30 is operably connected to a programable controller 62 so that the speed of dispensing coupons is directly timed with the rotational speed of the third wheel 23 and hub 21. It is therefore desirable that the positioning of the coupon into the third wheel pockets 22 is controlled by the controller 62. Thus, controller 62 is operably connected also to encoder 60 which reads the rotational speed and position of shaft 61 as input. Shaft 61 is timed correspondingly with the rotational speed of hub 21 such that encoder 60 provides a real time speed and position analysis of third wheel 23 and positioning of the third wheel pockets 21 thereon. Further, controller 62 may therefore read the rotational speed of hub 21 and adequately control dispensing of coupons from magazine 36 as well as control valve 33 feeding high pressure air to nozzle 32. Thus, controller 62 obtains the rotational speed information from the third wheel portion 20 of the hinged lid cigarette pack machinery and therefore dispenses the coupons at the appropriate time.

Those skilled in the art will recognize that the apparatus of the present coupon inserter for hinged lid packs has many applications and that the present invention is not limited to the representative examples disclosed herein. Moreover, the scope of the present invention covers conventially known variations and modifications to the system components described herein as would be known by those skilled in the art.

We claim:

1. A coupon inserter for hinged lid packs, comprising:

a third wheel on a hinged lid pack forming machine, said third wheel having a plurality of third wheel pockets on the peripheral edge;

a rail on which said plurality of third wheel pockets travel upon;

at least one rail guide on said rail, said at least one rail guide engageable with each of said third wheel pockets;

a coupon insert machine, said Coupon insert machine sequentially depositing coupons into each of said third wheel pockets;

whereby each of said third wheel pockets sequentially receive a plurality of cigarettes packed in a liner material.

2. The coupon inserter of claim 1 further comprising an air nozzle, said air nozzle supplying pressurized air to blow each of said coupons into said third wheel pocket.

3. The coupon inserter of claim 1 wherein each of said three wheel pockets have at least one rail guide insert which is engageable with at least one rail guide of said rail.

4. The coupon inserter of claim 1 further comprising:

a vacuum source;

a plurality of apertures in said rail guide, said apertures in flow communication with said vacuum source;

an air vacuum line connecting said vacuum source with said plurality of apertures.

5. The coupon inserter of claim 1 wherein said coupon insert machine comprises:

a coupon magazine containing a stack of coupons;

a transfer belt which receives a coupon from said stack of coupons at one distal end and deposits said coupon at the opposite distal end;

an air nozzle in flow communication with a high pressure air source such that when each of said coupons is deposited at the distal end of said transfer belt said air nozzle blows pressurized air downward onto said deposited coupon.

6. The coupon inserter of claim 5 wherein said air nozzle is in flow communication with an air valve, said air valve and said coupon inserter operable to blow said air onto said deposited coupon.

7. The coupon inserter of claim 6 further comprising:

a controller;

an encoder affixed to a rotatable shaft, said rotatable shaft representative of the rotational speed of said third wheel;

wherein said controller is operably connected to said coupon inserter, said air nozzle and said encoder.

8. The coupon inserter of claim 7 whereby each of said third wheel pockets sequentially receives said deposited coupon then receives said plurality of cigarettes wrapped in said liner material.

9. The coupon inserter of claim 5 wherein said third wheel pocket is comprised of a rectangular frame having a hollow interior, brackets for engaging an outwardly extending peripheral segment from said third wheel, and rail guide inserts, wherein said rail guide inserts are received within rail guides of said rail.

10. A method of inserting coupons into a hinged lid pack of cigarettes, comprising:

rotating a third wheel;

affixing a plurality of third wheel pockets on said rotating third wheel;

inserting from a magazine of coupons into said third wheel pockets coupons, one at a time;

timing said dispensing of said coupons from said magazine with said rotation of said third wheel;

inserting into said third wheel pocket containing said coupon a plurality of foil wrapped cigarettes;

blowing pressurized air downward onto each of said dispenses coupons;

plunging said foil wrapped cigarettes and said coupon from said third wheel pocket into a pocket containing an innerframe.

11. The method of claim 10 wherein said third wheel pocket rotates on a rail, said rail having a rail guide formed therein, said third wheel pocket having a rail guide insert, said insert moving within said rail guide of said rail.

12. The method of claim 11 further comprising:

providing a plurality of vacuum apertures in said rail;

connecting a vacuum source to each of said plurality of apertures;

whereby said coupon inserted into said third wheel pocket remains securely retained therein by said vacuum apertures as said third wheel pocket rotates on said rail.

13. The method of claim 12 further comprising:

providing a multi-stage dispensing device to remove coupons from said magazine of coupons;

operably connecting a controller to said multi-stage dispensing device;

depositing said coupons in timed relationship with the rotation of said third wheel;

blowing high pressure air downward onto said deposited coupon prior to continued rotation of said third wheel.

14. A coupon inserter for hinged lid packs, comprising:

a third wheel on a hinged lid pack forming machine, said third wheel having a plurality of third wheel pockets on the peripheral edge;

a rail on which said plurality of third wheel pockets travel upon and located therebelow, said rail having a groove to receive said pockets;

a coupon insert machine, said coupon insert machine sequentially depositing coupons into each of said third wheel pockets, wherein each of said third wheel pockets receive cigarettes packed in a liner material.

15. A coupon inserter for cigarette packs, comprising:

a wheel on a cigarette pack forming machine, said wheel having a plurality of pockets on the peripheral edge;

a rail on which said plurality of pockets travel upon, said rail having a groove to receive said pockets;

a coupon insert machine, said coupon insert machine sequentially depositing coupons into the empty interior of each of said pockets;

wherein each of said pockets receive cigarettes packed in a liner material.

* * * * *